United States Patent [19]

Kicinski

[11] 4,296,832

[45] Oct. 27, 1981

[54] EXHAUST MUFFLER

[75] Inventor: Kenneth J. Kicinski, Stoughton, Wis.

[73] Assignee: Nelson Industries, Inc., Stoughton, Wis.

[21] Appl. No.: 94,001

[22] Filed: Nov. 14, 1979

[51] Int. Cl.[3] ..... F01N 1/00

[52] U.S. Cl. ..... 181/255; 181/272

[58] Field of Search ..... 181/247–255, 181/264–269, 272, 276

[56] References Cited

U.S. PATENT DOCUMENTS

| | | | |
|---|---|---|---|
| 1,881,051 | 10/1932 | Haas | 181/264 |
| 2,850,111 | 9/1958 | Nelson | 181/265 |
| 4,143,739 | 3/1979 | Nordlie | 181/265 |
| 4,192,403 | 3/1980 | Nakagawa et al. | 181/272 |

*Primary Examiner*—L. T. Hix

*Assistant Examiner*—Benjamin R. Fuller

*Attorney, Agent, or Firm*—Andrus, Sceales, Starke & Sawall

[57] ABSTRACT

An exhaust muffler comprising an outer body having open ends which are enclosed by heads. An exhaust gas inlet tube is mounted in an opening in one head, while an outlet tube is mounted in an opening in the opposite end. The adjacent ends of the inlet and outlet tubes are spaced apart within the body. A baffle is secured to the inner end of the inlet tube, closing off the tube, and the peripheral edge of the baffle is spaced from the body to provide an annular passage. Exhaust gas and sound energy entering the inlet pipe are directed outwardly by the baffle through perforations in the tube, and the gas then passes through the annular passage and is discharged from the body through the outlet tube.

7 Claims, 2 Drawing Figures

EXHAUST MUFFLER

BACKGROUND OF THE INVENTION

Exhaust is a major contributor to the overall sound level of trucks and off-road vehicles. One common form of muffler which has been used in the past in conjunction with vehicle exhaust systems is the plug-type in which the inner end of the exhaust inlet tube is plugged or blocked off, thereby causing the exhaust gas to flow radially outward through perforations in the inlet tube and then flow longitudinally along the inner wall of the body to the outlet tube for discharge to the atmosphere.

Floating baffles or flanges have been used in the past in conjunction with plug-type mufflers to define sound attenuating chambers within the muffler body. With this construction, the baffle is secured around the inlet or outlet tube and the peripheral edge of the flange is unattached to the body.

SUMMARY OF THE INVENTION

The invention is directed to an improved muffler construction having particular use for trucks and off-road vehicles. The muffler comprises an outer body or casing having open ends which are enclosed by heads. An exhaust inlet tube, which is connected to the exhaust pipe of the vehicle, is mounted within an opening in one head, while an outlet tube is mounted in the opposite head and is disposed coaxially with the inlet tube. The adjacent ends of the inlet and outlet tubes are spaced apart.

The space between the inlet tube and the body, as well as the space between the outlet tube and the body, defines a series of sound attenuating chambers.

In accordance with the invention, a floating baffle or flange is secured across the inner end of the inlet tube and serves to close off the inlet tube. The baffle extends radially outward from the inlet tube and the peripheral edge of the baffle is provided with an annular flange, which extends in a downstream direction and is spaced from the inner surface of the body to provide an annular passage.

The exhaust gas enters the inlet pipe and is directed outwardly through perforations in the inlet tube by the floating baffle into the sound attenuating chambers. The exhaust gas then passes through the annular passage between the floating baffle and the body and is disharged from the sound attenuating chambers through the outlet tube to the atmosphere.

The floating baffle performs multiple functions. The baffle, along with other support baffles, divides the interior of the muffler body into a series of separate sound attenuating chambers. Secondly, it closes off the end of the exhaust inlet tube, forcing the exhaust gas and sound energy through the perforations in the inlet tube and into the sound attenuating chambers.

As a third function, the floating baffle can be used to control the back pressure of the muffler. In this regard, the baffle can be made in different diameters, thus varying the cross sectional area of the passage between the baffle and the body and allowing regulation of back pressure for various flow rates of exhaust gas.

Through use of the floating baffle the material cost and weight of the muffler is reduced over conventional plug-type mufflers. In addition, the muffler has reduced labor costs as it can be more easily assembled than conventional types.

Other objects and advantages will appear in the course of the following description.

DESCRIPTION OF THE DRAWINGS

The drawings illustrate the best mode presently contemplated of carrying out the invention.

In the drawings.

DESCRIPTION OF THE PREFERRED EMBODIMENT

The drawings illustrate an exhaust muffler having particular use with the exhaust system of a truck or off-road vehicle. The muffler includes an outer, generally cylindrical body or casing 1 having open ends which are enclosed by heads 2 and 3.

Figure 1:
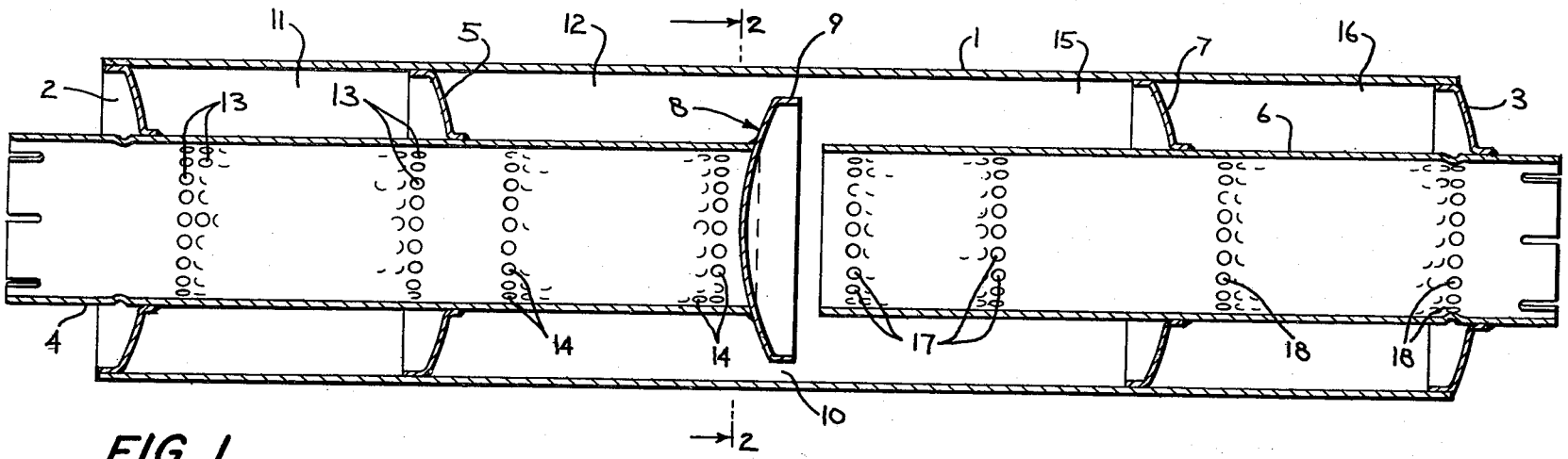
FIG. 1 is a longitudinal section of the muffler construction of the invention.
Figure 2:
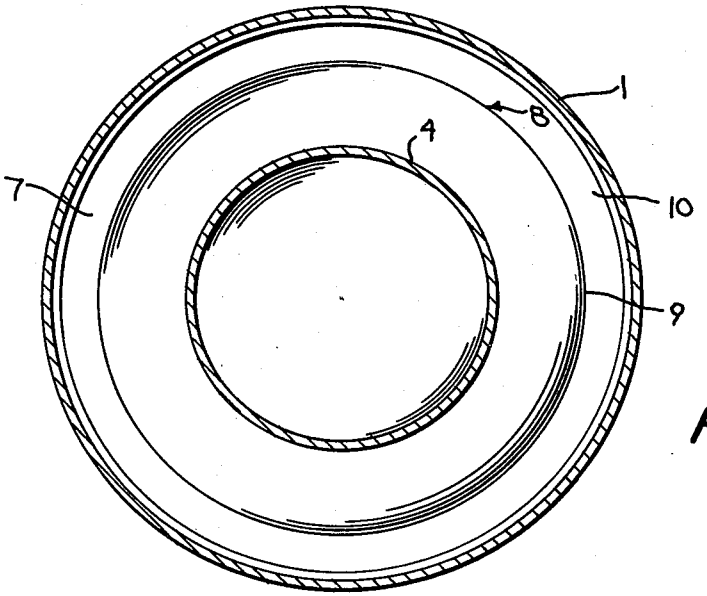
FIG. 2 is a section taken along line 2—2 of FIG. 1.

An exhaust inlet tube 4, which is connected to the exhaust pipe of the vehicle, is mounted within an opening in the lower head 2 and the central portion of the inlet tube is supported from the body 1 by means of a support baffle 5. As illustrated in FIG. 1, the inlet tube 4 is welded, or otherwise secured, within the central opening in baffle 5, and the outer peripheral edge of the baffle is secured to the inner surface of the body 1.

Mounted centrally within the upper head 3 is an exhaust gas outlet tube 6, and the central portion of the outlet tube is supported by means of a baffle 7, which is similar in construction to baffle 5, and connects the outlet tube 6 with the body 1.

As shown in FIG. 1, the inlet and outlet tubes 4 and 6 are disposed coaxially within the body 1, and the adjacent ends of the tubes are spaced apart.

In accordance with the invention, a floating baffle or flange 8 is secured across the inner end of the inlet tube 4 and serves to close off the inlet tube. The baffle 8 extends radially outward from the inlet tube, and the peripheral edge of the baffle 8 is provided with a flange 9 which extends in a downstream direction and is spaced from the body 1 to provide an annular passage 10. As shown in FIG. 1, the central portion of the floating baffle 8 is generally curved or convex in an upstream direction.

The space between the head 2 and the baffle 5 defines a closed resonating chamber 11, while the space between the baffle 5 and the floating baffle 8 defines a sound attenuating chamber 12. The inlet tube 4 is provided with a plurality of perforations or ports 13 which provide communication between the interior of the inlet tube and the chamber 11, and similarly, the tube 4 is provided with a second group of ports or perforations 14 which provide a fluid connection between the interior of the inlet tube and the chamber 12.

The space between the floating baffle 8 and the baffle 7 defines a sound attenuating chamber 15, and similarly the space between the baffle 7 and the upper head 3 defines a closed upper resonating chamber 16. A group of ports or perforations 17 establish communication between chamber 15 and the interior or the outlet tube 6, while a group of ports or perforations 18 provide communication between the interior of the outlet tube and the chamber 16. The lower or inner end of the outlet tube 6 is open.

As the baffle 8 closes off the inner end of the inlet tube 4, the exhaust gas and sound energy entering the inlet tube is directed outwardly through the perforations 13 and 14 into the sound attenuating chambers 11 and 12. The exhaust gas and sound energy then passes from chamber 12 through the annular pasage 10 between the flange 9 of baffle 8 and the body 1 and into the open inner end of the outlet tube 6, as well as passing through the perforations 17 into the outlet tube.

The floating baffle 8 not only plugs off the end of the inlet tube, thereby forcing the exhaust gas outwardly through the perforations and into the chambers 11 and 12, but it also serves, along with baffles 5 and 7, to divide the space within the body into sound attenuating chambers.

The cross-sectional area of the passage 10 between the baffle 8 and the muffler body may control the back pressure of the muffler. By fabricating baffle 8 with different diameters, the back pressure may be regulated for various flow rates of exhaust gas.

The use of the floating baffle 8 not only decreases the material cost and weight of the muffler, but also reduces labor costs by eliminating the necessity of having to weld the peripheral edge of the baffle to the muffler body at a relative inaccessible location.

While the drawings have illustrated the inlet tube 4 and outlet tube 6 extending axially through heads 2 and 3, it is contemplated that the tubes 4 and 6 can instead extend laterally through the body 1, depending on requirements of the exhaust system. Furthermore, the invention is not limited to the use of the supporting baffles 5 and 7. If the muffler has a relatively short length, one or both of the support baffles 5 and 7 can be eliminated. On the other hand, if the muffler has a long length, a number of supporting baffles may be employed.

Various modes of carrying out the invention are contemplated as being within the scope of the following claims particularly pointing out and distinctly claiming the subject matter which is regarded as the invention.

I claim:

1. An exhaust muffler, comprising an outer casing including a body having open opposite ends and including a pair of heads to enclose the open ends of the body, an exhaust inlet tube adapted to conduct exhaust gas to the muffler and mounted within an opening in the casing, a gas outlet tube mounted within an opening in the casing, a first baffle disposed within the casing and secured across the inner end of the inlet tube, said baffle extending radially outward beyond said inlet tube, and the peripheral edge of said baffle being spaced from the inner wall of said body, a flange disposed on the outer peripheral edge of said baffle and extending longitudinally of said body to provide an annular passage between said flange and said body said baffle being free of attachment to said body, said inlet tube being spaced inwardly from said body to provide a chamber therebetween and said inlet tube having a plurality of perforations providing communication between the interior of the inlet tube and said chamber, said baffle having an imperforate central section closing off the inner end of said inlet tube, whereby the exhaust gas and the sound energy is directed outwardly through said perforations into said chamber and then passes through said annular passage for discharge through said outlet tube.

2. The muffler of claim 1, and including a second baffle disposed between said first baffle and one of said heads and connecting the inlet tube to said body, said second baffle dividing said chamber into a pair of compartments.

3. The muffler of claim 2, wherein said perforations provide communication between the interior of said inlet tube and said compartments.

4. The muffler of claim 1, wherein said first baffle is generally convex in a direction facing upstream.

5. The muffler construction of claim 1, wherein the inner end of the outlet tube is open, and said outlet tube is provided with a plurality of second perforations.

6. An exhaust muffler, comprising a body having open opposite ends, a first head to enclose one end of said body, a second head to enclose the opposite end of the body, an inlet exhaust tube adapted to conduct the exhaust gas to the body and mounted within an opening in said first head, an outlet tube for discharging gas from the body and mounted within an opening in said second head, said inlet and outlet tubes being disposed coaxially of said muffler with the adjacent ends of said tubes being spaced apart, a first baffle secured across the inner end of the inlet tube and closing off said inner end, said first baffle extending radially outward from said inlet tube with the periphery of said baffle having a flange extending in a downstream direction and spaced from the inner surface of said body to provide an annular passage, and a support member disposed between the first head and said baffle and interconnecting the inlet tube and the body, said baffle being free of attachment to said body and the central portion of said baffle located radially inward of said flange being imperforate, said inlet tube being provided with a plurality of perforations, said baffle closing off the inner end of the inlet tube, whereby the exhaust gas entering the inlet tube is directed outwardly through said perforations and the gas then passes longitudinally through said annular passage for discharge from the outlet tube.

7. The muffler of claim 1, wherein the inlet tube extends through a first of said heads and the outlet tube extends through a second of said heads, said inlet and outlet tubes being coaxial and the inner ends of the tubes being spaced apart.

* * * * *